United States Patent [19]

Feldman

[11] 4,336,646

[45] Jun. 29, 1982

[54] APPARATUS FOR SHEARING AND CRIMPING

[75] Inventor: Steven Feldman, Seminole, Fla.

[73] Assignee: AMP Incorporated, Harrisburg, Pa.

[21] Appl. No.: 197,403

[22] Filed: Oct. 16, 1980

[51] Int. Cl.[3] ..... H01R 43/04

[52] U.S. Cl. ..... 29/564.2; 29/33 M; 29/566.3; 29/753; 29/863; 72/326; 72/402

[58] Field of Search ..... 29/566.3, 564.2, 751, 29/753, 761, 863, 517; 72/325, 326, 402; 339/177

[56] References Cited

U.S. PATENT DOCUMENTS

| | | | |
|---|---|---|---|
| 941,032 | 11/1909 | McCarthy | 29/761 X |
| 2,280,352 | 4/1942 | Penfold et al. | 29/863 |
| 2,340,360 | 2/1944 | Alden | 29/33 M X |
| 3,252,316 | 5/1966 | Haucke | 72/402 |
| 3,484,922 | 12/1969 | Fritz et al. | 29/753 |
| 3,555,672 | 1/1971 | O'Keefe et al. | 29/564.2 X |
| 3,781,763 | 12/1973 | Feeser | 339/91 |
| 3,803,694 | 4/1974 | Hermann | 29/761 X |
| 4,019,236 | 4/1977 | Osman | 29/753 |
| 4,178,679 | 12/1979 | Lichtenstein | 29/753 X |

FOREIGN PATENT DOCUMENTS

| | | | |
|---|---|---|---|
| 951885 | 7/1974 | Canada | 29/753 |

*Primary Examiner*—William R. Briggs
*Attorney, Agent, or Firm*—F. Brice Faller

[57] ABSTRACT

Apparatus comprises a plug holder having a passage therein profiled to axially receive a plug body with a metal sleeve preassembled thereto. Neck dies slideably mounted in the holder move radially inward to shear sleeve and crimp it into a circumferential recess in the plug body and a nose die slideably mounted in the holder moves axially inward to form the sleeve to a tapered leading end of the plug.

2 Claims, 9 Drawing Figures

APPARATUS FOR SHEARING AND CRIMPING

BACKGROUND OF THE INVENTION

The present invention relates to an apparatus for shearing a metal sleeve against a body to which the sleeve is crimped.

The apparatus is especially suited to manufacturing a phone plug of the type described in U.S. patent application Ser. No. 100,667, which application is hereby incorporated by reference. The phone plug is manufactured from only two pieces in addition to wires terminated thereto, but requires an apparatus capable of shearing a tubular metal sleeve against a dielectric plug body in order to form discrete conductive surfaces on the body. The apparatus makes possible the mass production and termination of this simple and inexpensive plug.

SUMMARY OF THE INVENTION

The apparatus of the present invention employes dies which cooperate with the workpiece itself to shear the tubular sleeve into discrete conductive surfaces. The die surfaces meet the tubular sleeve at apertures therein and progressively shear the sleeve in scissor fashion by bearing against a sharply converging shoulder in the plug body as the dies move inwardly. The progressive shear is the result of the profile of the die surface, which is semi-circular in cross section but of smaller radius than the sleeve. Were it the same radius, the plastic plug body would be deformed by the force of the die bearing against the entire shear section of the sleeve at once. The die surfaces are further profiled to form the sleeve into a circumferential recess or neck in the plug which lies adjacent to the sharply converging shoulder. The profile of the die surface is thus determined by the shape of the neck.

A nose die is also provided in the apparatus to form the second conductive surface to the leading end of the plug body. The neck dies grip the plug body firmly subsequent to shearing and crimping to position it as the nose die advances.

It is thus an object of the present invention to provide an apparatus cooperable with a plastic workpiece to shear a piece of metal against the workpiece and crimp it thereto.

It is a further object to provide an apparatus adapted to the manufacture of a coaxial phone plug which uses only two pieces.

These and other objects achieved by the present invention will be apparent to one skilled in the art upon examining the detailed description and drawings which follow.

DETAILED DESCRIPTION OF THE PREFERRED EMBODIMENT

Figure 1:
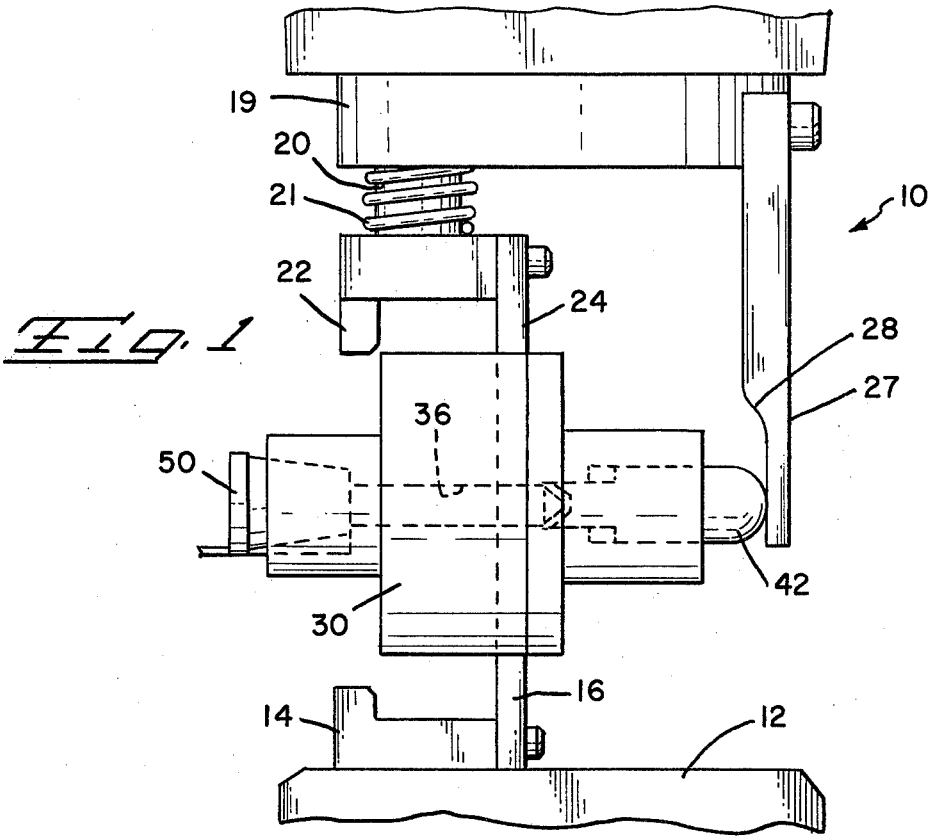
FIG. 1 is a side view of the termination apparatus.

The preferred embodiment of crimping apparatus 10 appears in FIG. 1 and comprises a stationary base 12, a press 19, and a holder 30 into which the workpiece or plug body 50 is positioned. The base or anvil 12 has a stop 14 fixedly mounted thereon and a lower neck die 16 fixedly mounted to the lower stop 14. The press 19 has a piston 20 slideably mounted therein, the piston being surrounded by a spring 21 which bears against the press 19 and an upper stop 22 fixedly attached to the piston 20. The piston has an upper neck die 24 mounted thereto which extends into holder 30 opposite lower neck die 16. The holder 30 has a ram or nose die 42 slideably mounted therein and protruding therefrom which is borne against by linear cam 27 which is fixedly mounted to the press 19.

Figure 2A:
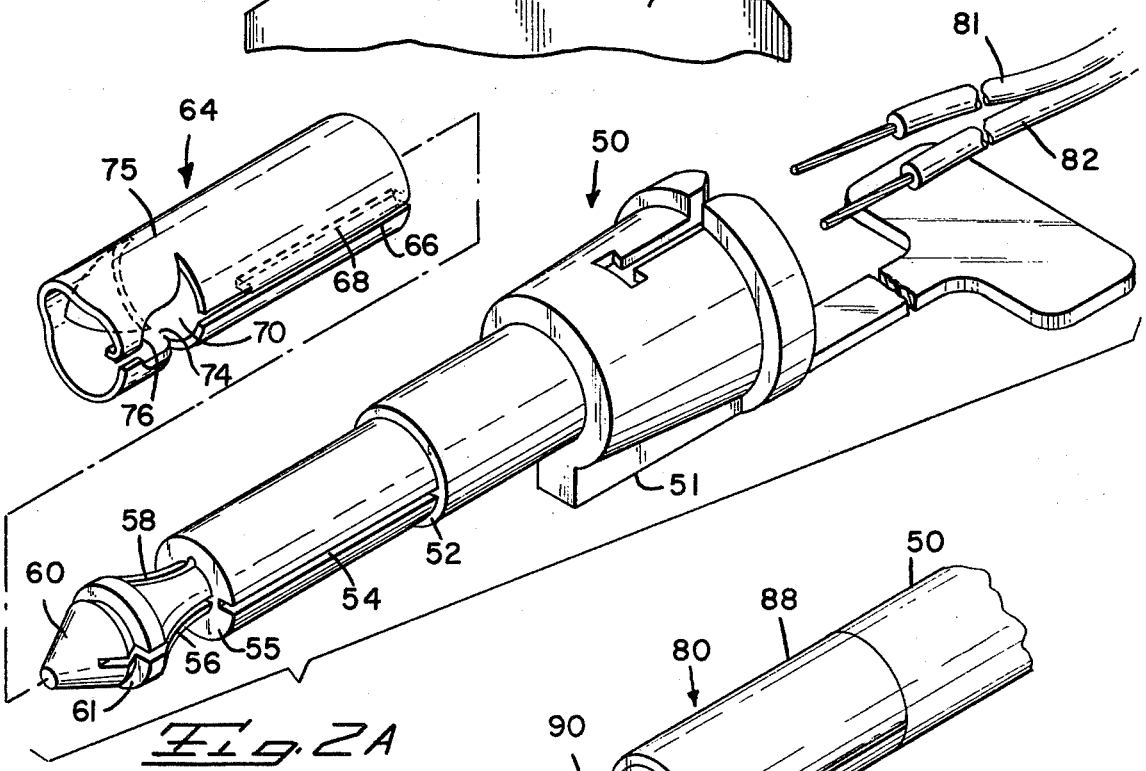
FIG. 2A is an exploded perspective of the plug prior to assembly.

FIG. 2A is an exploded perspective of the workpiece which consists of a plug body 50, a metal sleeve 64, and wires 81, 82 to be terminated. The purpose of apparatus 10 is to assemble these components to form a phone plug of the type fully described in U.S. application Ser. No. 100,667. The plug appearing in the present application incorporates several minor changes, most notably the use of a folded edge 68 in seam 66 of sleeve 64 which prevents movement of the sleeve 64 relative to plug body 50; the shape of apertures 70 in the sleeve 64, which has been modified to a bell-profile to effect formation of a more complete conductive surface in the neck of the plug; and the seam 66 intersects an aperture 70 rather than running between the opposed apertures. Referring still to FIG. 2A, other salient features of the plug body 50 relevant to the practice of the present invention include key 51, shoulder 52, aligning groove 54, converging shoulder 55, circumferential recess or neck 56 having a conductor groove 58 therein, a tapered leading end 60, and an annular groove 61 in the end 60.

Figure 2B:
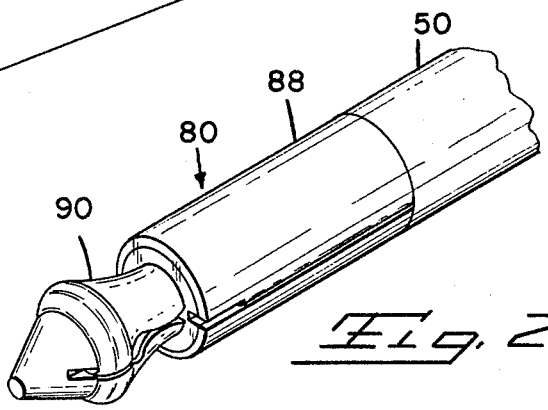
FIG. 2B is a perspective of an assembled plug.

To assemble the plug 80 (FIG. 2B), wires 81, 82 are first inserted into the plug body 50 as described in application Ser. No. 100,667. Sleeve 64 is then slid over the end 60 of the plug until it abuts shoulder 52 and the flat sides of bell shaped apertures 70 align with sharply converging shoulder 55. The folded edge 68 fits into groove 54 to align the sleeve 64 on the plug body 50. The groove 54 is profiled more deeply remote from shoulder 55 so that the folded edge 68, which is remote from aperture 70, prevents the sleeve from sliding off.

Figure 4A:
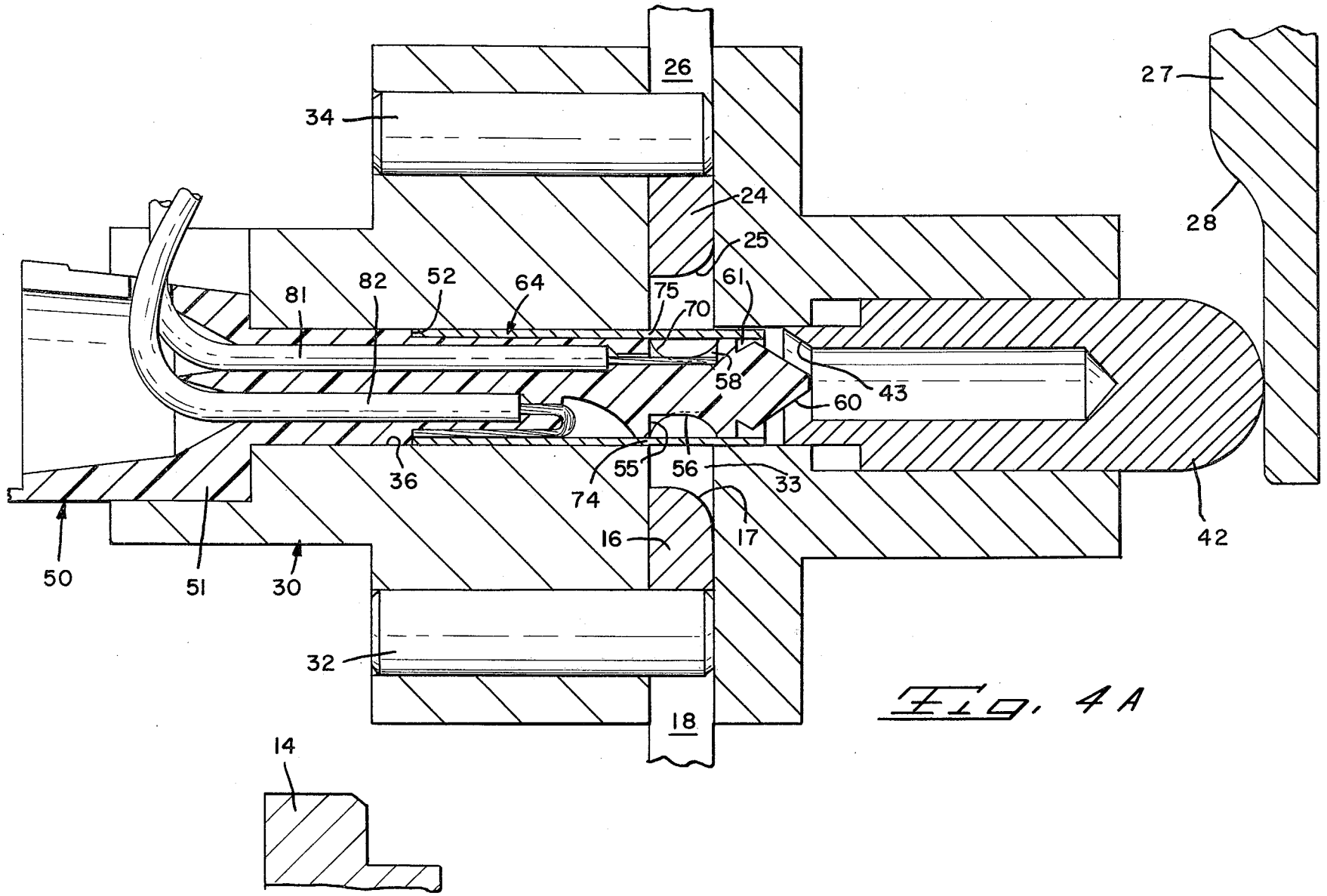
FIG. 4A is a side cross-section taken along the axis of the plug which corresponds to FIG. 3A.

The plug body 50 with wires 81, 82 therein and sleeve 64 thereon is then slid into a profiled plug passage 36 in the holder 30 as shown cross sectionally in FIG. 4A. Key 51 allows only one radial alignment so that the apertures 70 may only be aligned one way in the passage 36, whereby the straits or shear sections 74, 75 of the sleeve 64 face die surfaces 17, 25 respectively. The die surfaces 17, 25 are on the upper and lower edgs of lower and upper dies 16, 24 respectively which are slideably mounted in die guide 33 in the plug holder 30.

Figure 3C:
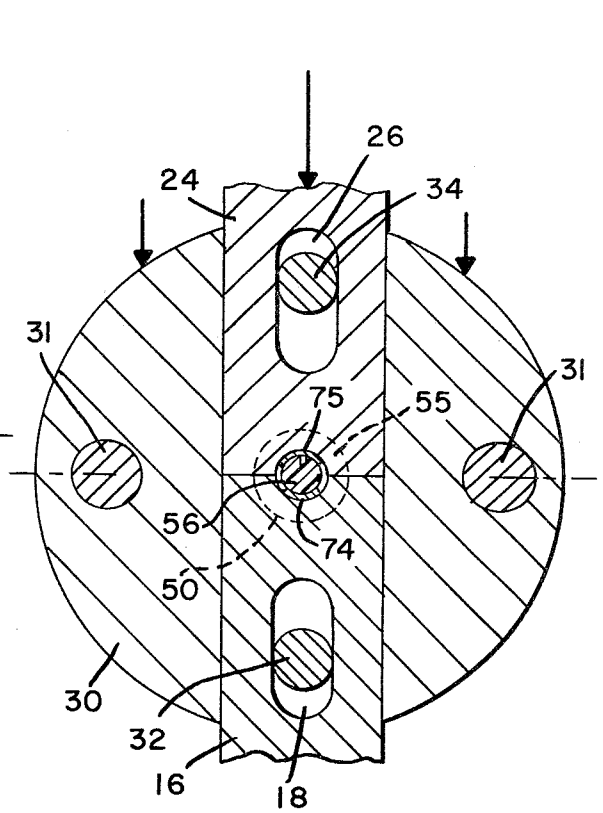
FIG. 3C is an end cross-section of the tooling taken through the neck after the metal sleeve is sheared and crimped to the neck.
Figure 3B:
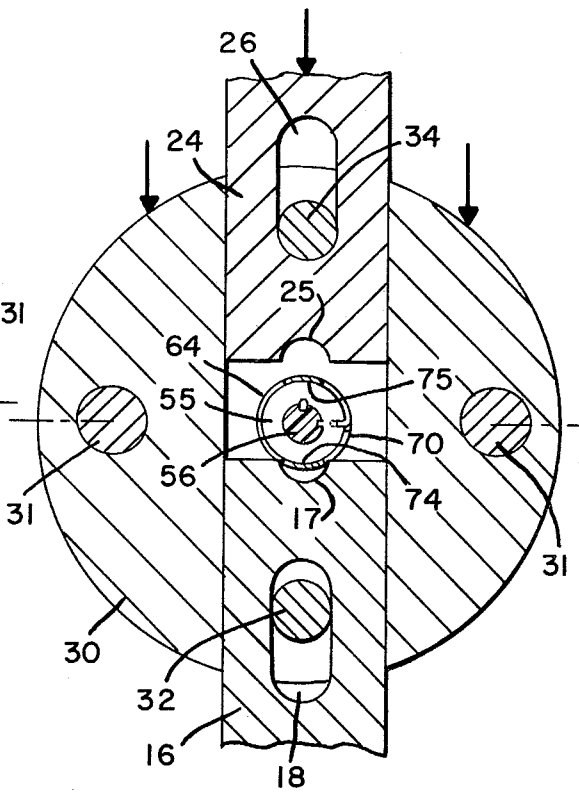
FIG. 3B is an end cross-section of the tooling taken through the neck as the plug holder drops and the lower neck die comes into contact with the metal sleeve.
Figure 3A:
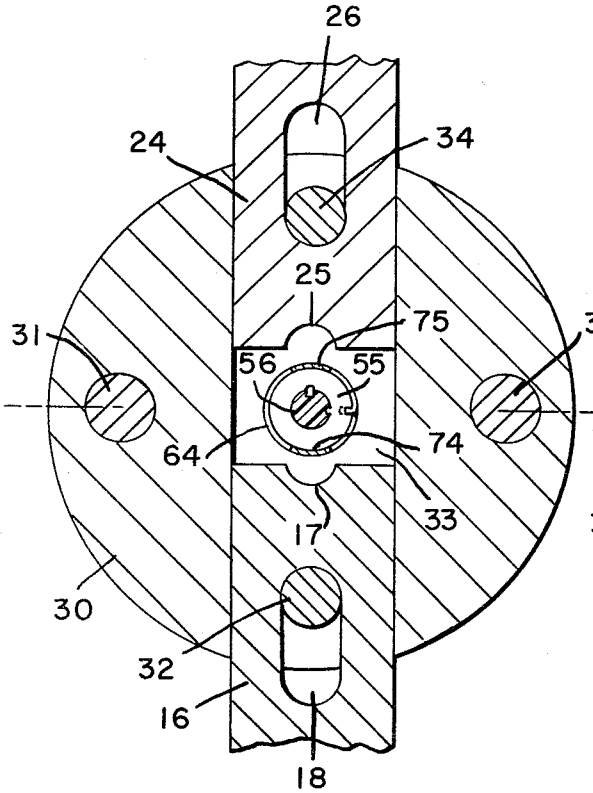
FIG. 3A is an end cross-section of the tooling taken through the neck of the plug prior to movement of the upper neck die.

The operation of the neck dies 16, 24 and their cooperation with plug holder 30 may be best understood by reference to FIGS. 3A, 3B, and 3C, which are end cross sections taken along the plane of shoulder 55 when the plug body 50 and sleeve 64 are in place in passage 36.

Referring to FIG. 3A, screws 31 are used to assemble the holder and lower and upper stop pins 32, 34 are fixedly mounted in guide 33. The dies 16, 24 fit closely in the die guide 33 and have slots 18, 26 therein which act on the stop pins 32, 34 to limit divergent travel of the dies 16, 24 and to position the holder 30 between the die surfaces 17, 25 when the plug body is initially placed in the passage 36. Lower neck die 16 remains stationary while upper neck die 24 and holder 30 drop under the action of descending press 19 (FIG. 1) until the position of FIG. 3B is attained. Here the lower shear section 74 comes to rest on lower die surface 17 and the holder 30, which is a floating member, becomes temporarily stationary while the press 19 and upper die 24 continue to descend. The press descends until the upper die surface 25 meets upper shear section 75, and continues to descend which simultaneously shears the lower and upper shear sections 74, 75 against converging shoulder 55 and crimps them into the neck 56 of the plug body 50 as shown in FIG. 3C.

Figure 4B:
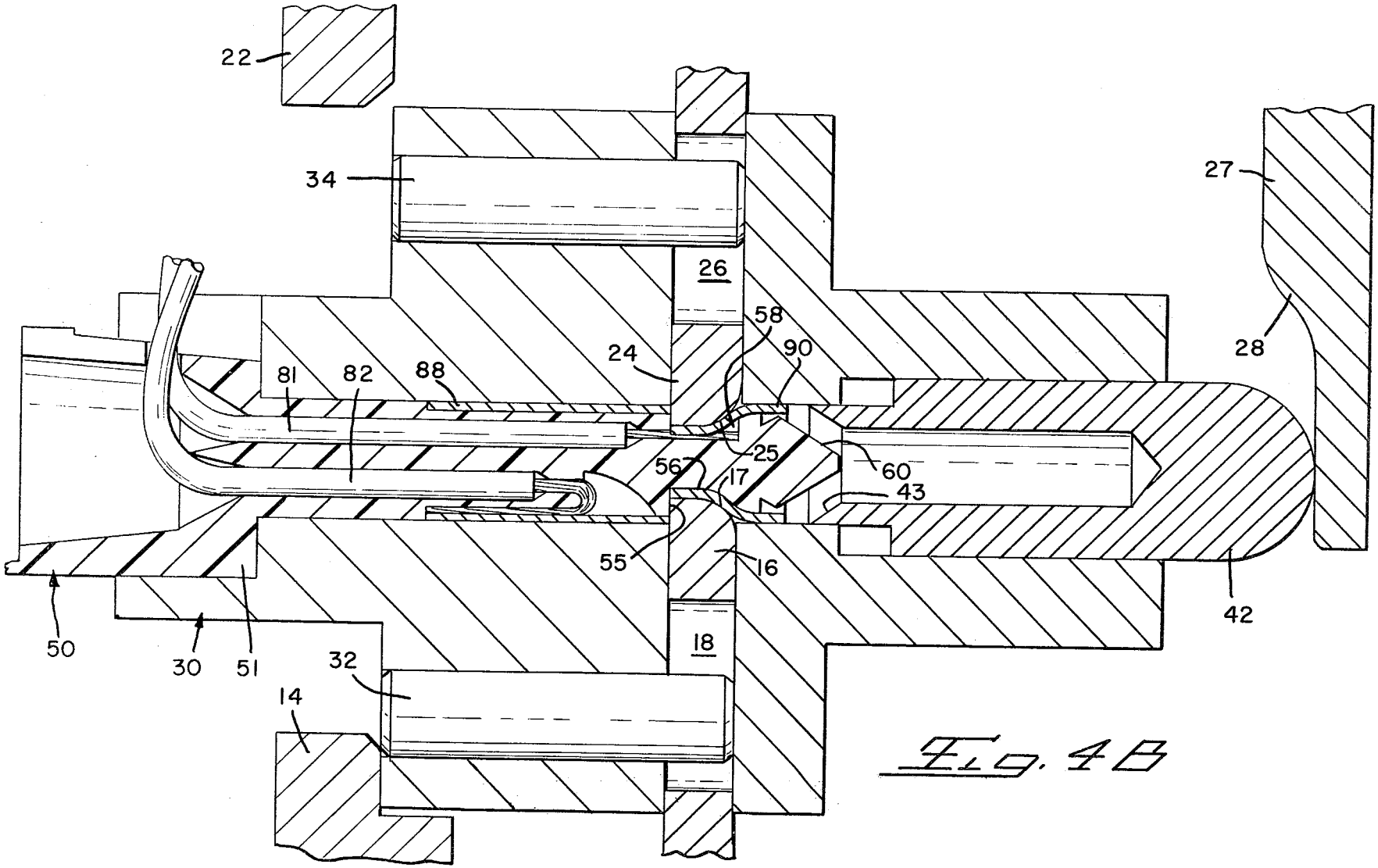
FIG. 4B is a side cross-section corresponding to FIG. 3C.

Note in FIG. 3B that the radius of die surfaces 17, 25 in this section is smaller than the radius of tubular sleeve 64. This geometry causes the die surfaces to first contact the shear sections 74, 75 only at the corners of bell shaped apertures 70. The die surfaces 17, 25 are profiled as symmetric halves of a truncated bell. See FIG. 4A. This causes the die surfaces to precisely position the pre-assembled plug body 50 and sleeve 64 axially in the passage 36 so that the shearing is effected at the smallest radius of the die surfaces 74, 75 as they press the shear sections 74, 75 against the shoulder 55 of the plug body 50. Shearing occurs progressively in a scissor action as the dies move convergently and shear the shear sections against the shoulder 55 from the corners of the apertures 70 toward the center of the shear sections. The dies continue to converge after shearing is completed until the second conductive surface 90 is against neck 56. See FIGS. 3C and 4B. The plug holder 30 moves down slightly as the dies 16, 24 enter the neck 56 until it is against stop 14 as shown in FIG. 4B. Note that the truncated bell profile of the shear surfaces 17, 25 causes second conductive surface 90 to conform closely to neck 56 of the plug body and further to firmly press wire 81 into groove 58. The spring 21 about piston 20 (FIG. 1) is stiff enough that it is not appreciably compressed during shearing of the sleeve 64.

Figure 4C:
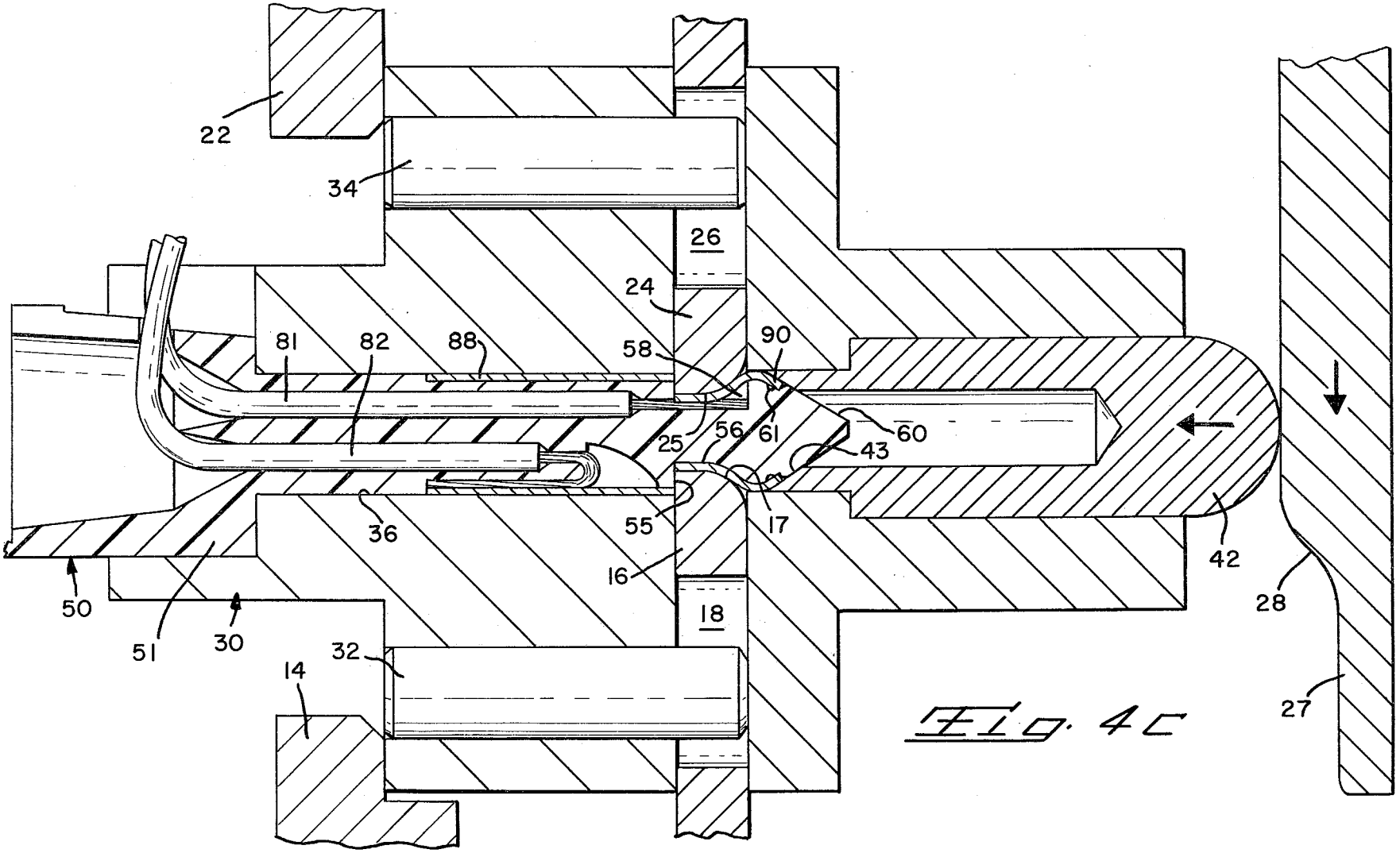
FIG. 4C is a side cross-section after the metal is crimped to the nose of the plug body.

Once the shearing is completed and the dies have crimped the second conductive surface 90 into the neck, continued downward movement of press 19 (FIG. 1) will cause the spring 21 to be compressed and the linear cam 27 will move downward until cam surface 28 bears against nose die 42 and forces it into the plug holder 30 to the position of FIG. 4C. The nose die surface 43, which is profiled as a truncated cone, forces the edge of the second conductive surface 90 into annular groove 61 of tapered leading end 60 of plug body 50. The plug holder 30 is firmly positioned by stops 14, 22 and the plug is firmly positioned in the passage in the plug holder by die surfaces 17, 25 which form a collar around the portion of second conductive surface 90 lying in neck 56. As the press returns upward the nose die 42 and neck dies 16, 24 retreat so that the complete plug 80 (FIG. 2B) may be removed from the passage 36 in the plug holder 30.

The plug body 50 is a plastic, which leads to an important effect during crimping of the second conductive surface 90. Referring still to FIG. 4C, the wire 81 has stranded conductor therein which lies in groove 58 where it passes into neck 56. This is borne against by second conductive surfaces 90 to effect electrical continuity. The action of nose die 42 forces the leading edge of the second conductive surface 90 into the plastic groove 61 in tapered leading end 60. This interference causes the plastic to spring back elastically when the nose die 42 retreats, which results in an opposite action in the neck 56, where the metal tends to spring into the neck. A residual spring force remains in the conductive surface 90, so that despite the tendency of the strands in wire 81 to spread out, a positive contact force remains. The integrity of the contact is thus assured.

The foregoing description is exemplary and not intended to limit the scope of the claims which follow.

What is claimed is:

1. An apparatus for shearing and crimping a preformed tubular metal sleeve to form discrete coaxial first and second conductive surfaces on a generally cylindrical dielectric plug body, said plug body having a tapered leading end and a circumferential recess spaced from said end, said metal sleeve being dimensioned to fit concentrically on said plug body and extend from said leading end to a point beyond said recess, said apparatus comprising:

a holder with a plug passage therein profiled to receive said plug body with said sleeve assembled thereto, a pair of opposed neck dies which are slideably mounted in said holder for radial movement toward said passage, said passage being dimensioned to position said plug body with said recess positioned centrally of said neck dies when said plug body with said sleeve assembled thereto is fully received in said passage, a nose die slideably mounted in said holder for axial movement toward said passage, actuating means for initially driving said neck dies radially inward toward said passage and thereafter to drive said nose die axially toward said passage, whereby, said plug body with said sleeve assembled thereto may be placed in said passage with said recess positioned centrally of said neck dies, said neck dies may be driven toward said plug body to shear said sleeve and crimp it into said recess forming said discrete first and second conductive surfaces, and said nose die may be moved axially toward said tapered leading end to form said sleeve thereto.

2. The apparatus of claim 1 wherein said actuating means comprises a press which moves downward toward a stationary anvil, said ram having one of said neck dies mounted resiliently thereto, said anvil having the other said neck die mounted fixedly thereto, said holder being carried slideably by said dies, said press having a linear cam mounted fixedly thereto positioned to engage said nose die and drive it normally of the direction of travel of the press, whereby downward motion of said press causes said neck dies to engage said plug and to shear and crimp said sleeve into said recess, and continued downward motion of said press causes said linear cam to bear on said nose die while said neck dies and said holder remain stationary and grip said plug body at said recess.

* * * * *